US011161268B2

(12) United States Patent
Nitta et al.

(10) Patent No.: US 11,161,268 B2
(45) Date of Patent: Nov. 2, 2021

(54) CUTTING APPARATUS

(71) Applicant: DISCO CORPORATION, Tokyo (JP)

(72) Inventors: Shuji Nitta, Tokyo (JP); Harunobu Yuzawa, Tokyo (JP); Yoshio Matsushita, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 0 days.

(21) Appl. No.: 17/094,116

(22) Filed: Nov. 10, 2020

(65) Prior Publication Data

US 2021/0154874 A1 May 27, 2021

(30) Foreign Application Priority Data

Nov. 27, 2019 (JP) ..... JP2019-214138

(51) Int. Cl.
*B26D 5/00* (2006.01)
*B26D 1/143* (2006.01)

(52) U.S. Cl.
CPC ..... *B26D 5/005* (2013.01); *B26D 1/143* (2013.01)

(58) Field of Classification Search
CPC ..... B26D 5/005; B26D 1/143; B26D 2007/2607; B26D 7/2614; B28D 5/022; B28D 5/0058; B28D 5/0076; B28D 5/0094; B28D 5/0064; B28D 5/0082; B30B 15/026; Y10S 100/918; Y10T 83/9473
See application file for complete search history.

(56) References Cited

U.S. PATENT DOCUMENTS

| | | | | |
|---|---|---|---|---|
| 6,030,326 | A * | 2/2000 | Azuma | B27B 5/32 483/31 |
| 9,314,853 | B2 * | 4/2016 | Wakita | B28D 5/022 |
| 9,724,838 | B2 * | 8/2017 | Wakita | B28D 5/022 |
| 2016/0207216 | A1 * | 7/2016 | Nitta | B23B 31/307 |
| 2017/0000305 | A1 * | 1/2017 | Gordon | A47L 9/2847 |
| 2019/0084124 | A1 * | 3/2019 | Sekiya | B27B 5/325 |

FOREIGN PATENT DOCUMENTS

JP 2002154054 A 5/2002

* cited by examiner

*Primary Examiner* — Jonathan G Riley
(74) *Attorney, Agent, or Firm* — Greer Burns & Crain Ltd.

(57) ABSTRACT

A control unit of a cutting apparatus has a suction checking function of determining that foreign matter is clogged in a suction hole and issuing an instruction on removal of the foreign matter in a case where the value of a pressure gauge before mounting of a cutting blade onto a mount is less than a first predetermined value, and a mounting checking function of inhibiting start of rotation of a rotary shaft in a case where the value of the pressure gauge after mounting of the cutting blade onto the mount does not reach a second predetermined value smaller than the first predetermined value and permitting the start of rotation of the rotary shaft in a case where the value of the pressure gauge after mounting of the cutting blade onto the mount has reached the second predetermined value.

3 Claims, 4 Drawing Sheets

CUTTING APPARATUS

BACKGROUND OF THE INVENTION

Field of the Invention

The present invention relates to a cutting apparatus including a holding mechanism that holds a workpiece, a cutting unit that rotatably supports a cutting blade provided at a periphery thereof with a cutting edge for cutting the workpiece held by the holding mechanism, and a feeding mechanism that puts the holding mechanism and the cutting unit into relative processing feeding.

Description of the Related Art

A wafer formed on a front surface thereof with a plurality of devices such as integrated circuits (ICs) and large-scale integrations (LSIs) in the state of being partitioned by streets is divided by a cutting apparatus provided with a cutting blade in a rotatable manner into individual device chips, and the thus divided device chips are utilized for electric apparatuses such as mobile phones and personal computers.

The present applicant has proposed a cutting apparatus with which it is possible to avoid use of a special tool necessary for fastening a cutting blade onto a mount by a nut and to avoid generation of individual differences due to the operator at the time of fastening the cutting blade onto the mount by the nut (see, for example, Japanese Patent Laid-open No. 2002-154054).

This cutting apparatus includes a holding mechanism that holds a workpiece, a cutting unit that rotatably supports a cutting blade provided at the periphery thereof with a cutting edge for cutting the work piece held by the holding mechanism, and a feeding mechanism that puts the holding mechanism and the cutting unit into relative processing feeding. The cutting unit includes a rotary shaft, a housing that rotatably supports the rotary shaft, and a mount that is formed at a tip end of the cutting blade and that holds the cutting blade. The mount includes a boss section that is inserted into an opening formed in the center of the cutting blade, a ring-shaped support section that is formed at the periphery of the boss section and that supports the cutting edge of the cutting blade in an exposed state, a suction hole that is opened between the boss section and the support section and that suction holds the cutting blade, and a communication passage that causes the suction hole to communicate with a suction source.

SUMMARY OF THE INVENTION

However, when cutting is conducted by rotating the cutting blade in a state in which foreign matter is interposed between the mount and the cutting blade and a sufficient suction force cannot be obtained, the wafer and the cutting blade may be damaged.

In addition, when foreign matter is clogged in the suction hole formed in the mount for suction holding the cutting blade, the cutting blade cannot be held sufficiently even if the suction pressure detected is at an appropriate value, and, if cutting is conducted by rotating the cutting blade in this state, the wafer and the cutting blade may be damaged similarly to the above-mentioned.

Accordingly, it is an object of the present invention to provide a cutting apparatus with which it is possible to suppress to a low level the possibility of damaging a wafer and a cutting blade.

In accordance with an aspect of the present invention, there is provided a cutting apparatus including: a holding mechanism that holds a workpiece; a cutting unit that rotatably supports a cutting blade provided at a periphery thereof with a cutting edge for cutting the workpiece held by the holding mechanism; and a feeding mechanism that puts the holding mechanism and the cutting unit into relative processing feeding, in which the cutting unit has a rotary shaft, a housing that rotatably supports the rotary shaft, and a mount that is formed at a tip end of the rotary shaft and that holds the cutting blade, the mount has a boss section that is inserted into an opening formed in a center of the cutting blade, a ring-shaped support section that is formed at a periphery of the boss section and that supports the cutting edge of the cutting blade in an exposed state, a suction hole that is opened between the boss section and the support section and that suction holds the cutting blade, and a communication passage causing the suction hole to communicate with a suction source, a pressure gauge is disposed in the communication passage, a control unit is connected to the pressure gauge, and the control unit has a suction checking function of determining that foreign matter is clogged in the suction hole and issuing an instruction on removal of the foreign matter in a case where the value of the pressure gauge before mounting of the cutting blade onto the mount is less than a first predetermined value, and a mounting checking function of inhibiting start of rotation of the rotary shaft in a case where the value of the pressure gauge after mounting of the cutting blade onto the mount does not reach a second predetermined value smaller than the first predetermined value and permitting the start of rotation of the rotary shaft in a case where the value of the pressure gauge after mounting of the cutting blade onto the mount has reached the second predetermined value.

In the described aspect of the present invention, preferably, the cutting apparatus further includes an operation panel that displays a button used for the suction checking function, in which the control unit changes the color of the button used for the suction checking function after the suction checking function is finished. In addition, in the described aspect of the present invention, preferably, the control unit inhibits execution of the mounting checking function in a case where the value of the pressure gauge when the suction checking function is performed is less than the first predetermined value, and permits execution of the mounting checking function in a case where the value of the pressure gauge when the suction checking function is performed is equal to or more than the first predetermined value.

Since the cutting apparatus according to the described aspect of the present invention has the aforementioned configuration, the possibility of damaging the wafer and the cutting blade can be suppressed to a low level. In addition, in the cutting apparatus according to the described aspect of the present invention, in the case where foreign matter is clogged in the suction hole formed in the mount, the clogging with the foreign matter is detected by the pressure gauge and an instruction on removal of the foreign matter is issued, before mounting of the cutting blade onto the mount. Therefore, it is possible to suppress to a low level the possibility that the cutting blade cannot be held sufficiently, notwithstanding the value of the pressure gauge before mounting of the cutting blade onto the mount is appropriate, with the result that the wafer and the cutting blade may be damaged when cutting is conducted by rotating the cutting blade.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

Figure 1:
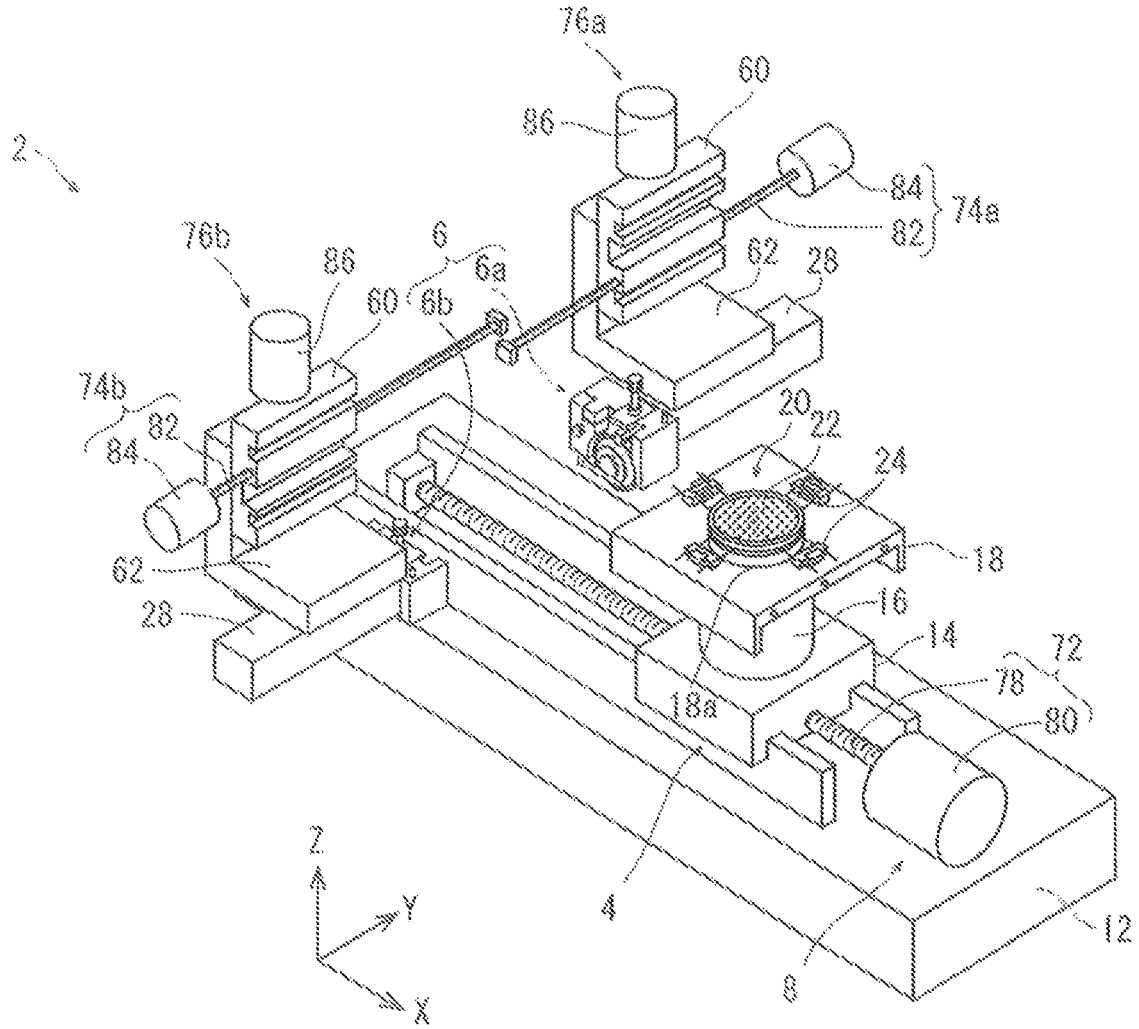
FIG. 1 is a partial perspective view of a cutting apparatus according to an embodiment of the present invention.

A preferred embodiment of a cutting apparatus configured according to the present invention will be described below, referring to the drawings.

A cutting apparatus 2 illustrated in FIG. 1 includes a holding mechanism (holding means) 4 that holds a workpiece, a cutting unit (cutting means) 6 that rotatably supports a cutting blade provided at a periphery thereof with a cutting edge for cutting the workpiece held by the holding mechanism 4, and a feeding mechanism (feeding means) 8 that puts the holding unit 4 and the cutting unit 6 into relative processing feeding. Note that in FIG. 1, an X-axis direction, a Y-axis direction, and a Z-axis direction which are orthogonal to one another are indicated by arrows X, Y, and Z. A plane defined by the X-axis direction and the Y-axis direction is substantially horizontal.

The holding mechanism 4 includes an X-axis movable plate 14 mounted on a base plate 12 movably in the X-axis direction, a support column 16 fixed to an upper surface of the X-axis movable plate 14, and a cover plate 18 fixed to an upper end of the support column 16. The cover plate 18 is formed with a circular opening 18*a*, and a chuck table 20 extending upward through the circular opening 18*a* is rotatably mounted on an upper end of the support column 16. The chuck table 20 is rotated around an axis extending in the vertical direction by a chuck table motor (not illustrated) incorporated in the support column 16.

A porous circular suction chuck 22 connected to a suction source (not illustrated) such as a vacuum pump is disposed at an upper end portion of the chuck table 20. In the chuck table 20, with a suction force generated at an upper surface of the suction chuck 22 by the suction source, the workpiece plated on an upper surface of the suction chuck 22 is suction held. In addition, a plurality of clamps 24 are disposed at a peripheral edge of the chuck table 20 at intervals in the circumferential direction.

Figure 2A:
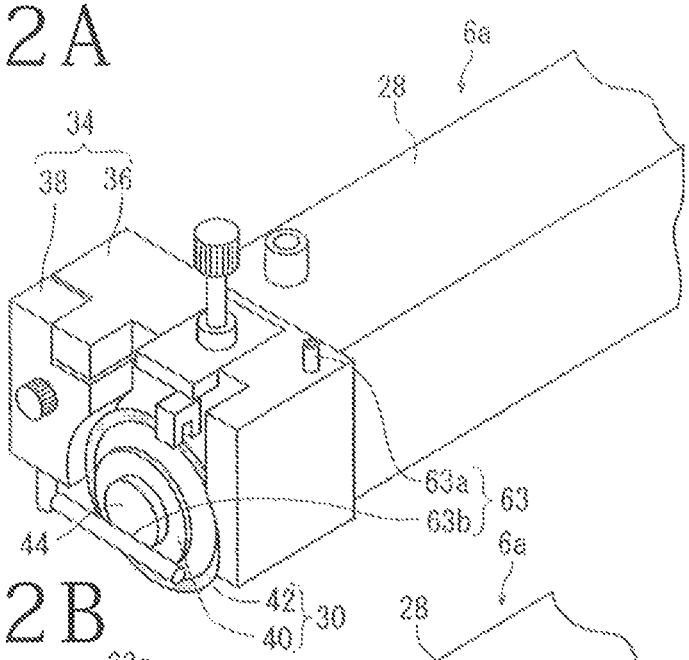
FIG. 2A is a partial perspective view of a cutting unit depicted in FIG. 1.
Figure 2B:
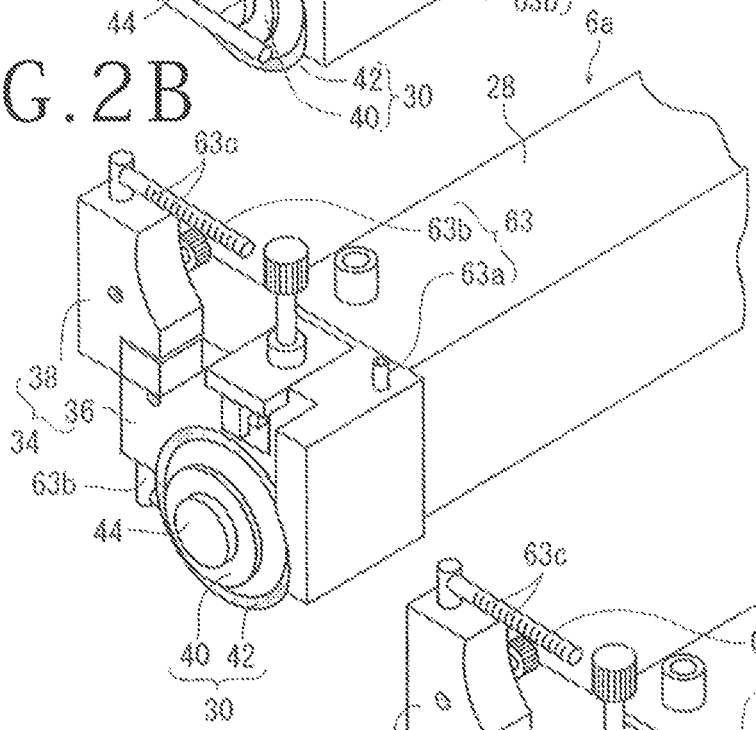
FIG. 2B is a perspective view depicting a state in which a movable section is flipped up from the state depicted in FIG. 2A.
Figure 2C:
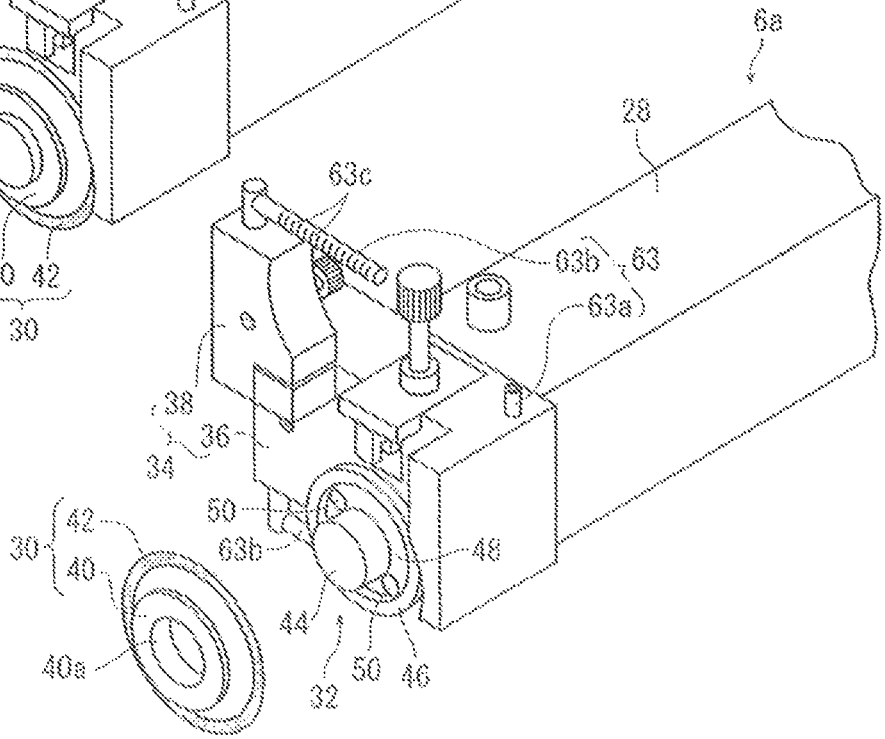
FIG. 2C is a perspective view depicting a state in which a cutting blade is detached from the state depicted in FIG. 2B.
Figure 3:
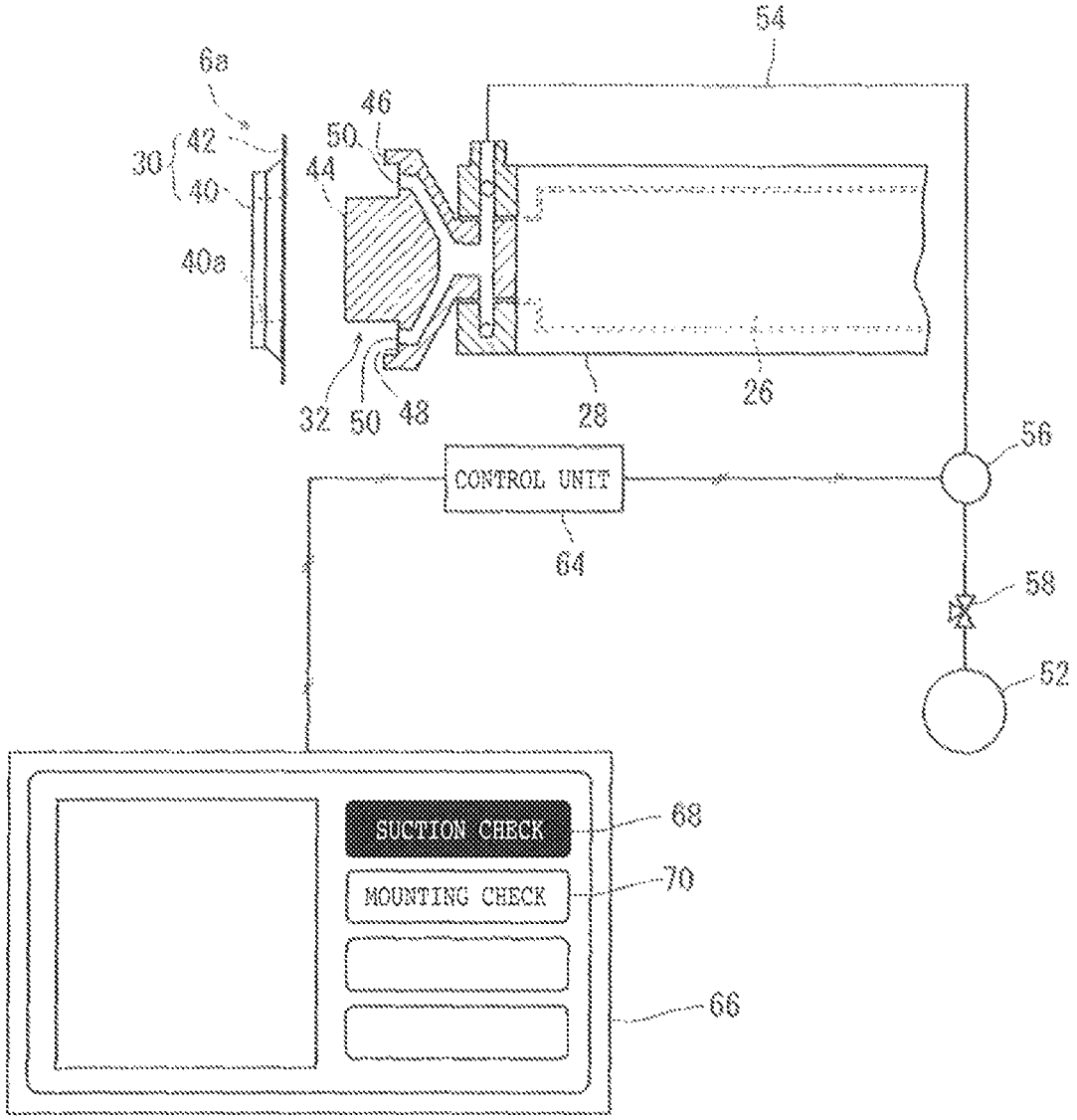
FIG. 3 is a partial sectional view of the cutting unit illustrated in FIG. 1 before the cutting blade is mounted onto a mount.
Figure 4:
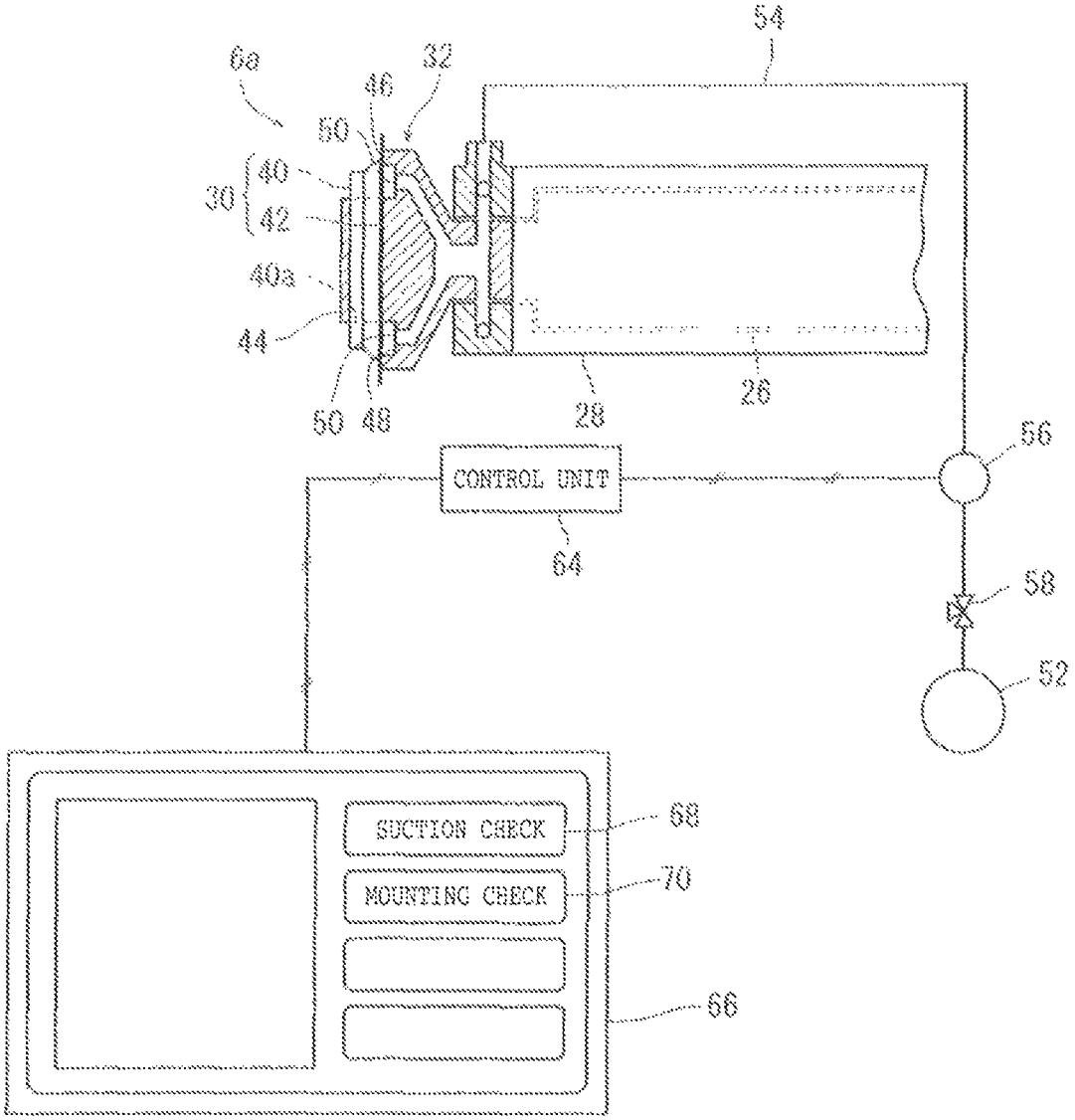
FIG. 4 is a partial sectional view of the cutting unit illustrated in FIG. 1 after the cutting blade is mounted onto the mount.

The cutting unit 6 in the embodiment illustrated includes a first cutting unit 6*a* and a second cutting unit 6*b* in which two cutting blades are disposed to face each other at an interval in the Y-axis direction. In the cutting unit 6 in the embodiment illustrated, the workpiece held by the holding mechanism 4 can be simultaneously cut by the two cutting blades. Referring to FIGS. 2 to 4, the first cutting unit 6*a* includes at least a rotary shaft 26 (see FIGS. 3 and 4), a housing 28 that rotatably supports the rotary shaft 26, and a mount 32 that is formed at a tip end of the rotary shaft 26 and holds a cutting blade 30.

A motor (not illustrated) for rotating the rotary shaft 26 is connected to the other end of the rotary shaft 26. As depicted in FIG. 2A and the like, a blade cover 34 is mounted to a tip end of the housing 28. The blade cover 34 includes a main section 36 fixed to the tip end of the housing 28, and a movable section 38 swingably supported on the main section 36. The cutting blade 30 includes a cylindrical base 40, and an annular cutting edge 42 mounted to a peripheral portion of one side surface of the base 40. The base 40 is formed in a central portion thereof with a circular opening 40*a*. Note that in FIGS. 3 and 4, the blade cover 34 is omitted for convenience' sake.

In continuing description while referring to FIGS. 3 and 4, the mount 32 includes a boss section 44 inserted into the opening 40*a* formed in the center of the cutting blade 30, a ring-shaped support section 46 that is formed at the periphery of the boss section 44 and supports the cutting edge 42 of the cutting blade 30 in an exposed state, a suction hole 50 that is opened between the boss section 44 and the support section 46 and suction holds the cutting blade 30, and a communication passage 54 causing the suction hole 50 to communicate with a suction source 52.

The boss section 44 is formed in a cylindrical shape, and the diameter of the boss section 44 corresponds to the diameter of the opening 40*a* of the base 40 of the cutting blade 30. The outside diameter of the support section 46 is smaller than the outside diameter of the cutting edge 42 of the cutting blade 30, such that when the cutting blade 30 is mounted to the mount 32, the cutting edge 42 is exposed from the mount 32. In addition, a tip end surface in the Y-axis direction of the support section 46 is retracted as compared to a tip end surface in the Y-axis direction of the boss section 44.

An annular recess 48 further retracted in the Y-axis direction as compared to the tip end of the support section 46 is provided between the boss section 44 and the support section 46, and the suction hole 50 for suction holding the cutting blade 30 is formed at the annular recess 48. The mount 32 in the embodiment illustrated is provided with a pair of suction holes 50. While only one suction hole 50 may suffice, two or more suction holes 50 are preferably formed at regular angular intervals, for improving rotation balance. As depicted in FIGS. 3 and 4, each of the suction holes 50 communicates with the suction source 52 via the communication passage 54. A pressure gauge 56 for measuring the pressure in the communication passage 54 and a valve 58 for opening and closing the communication passage 54 are disposed in the communication passage 54. In the mount 32, with the suction source 52 operated in a state in which the valve 58 is opened, the cutting blade 30 fitted to the boss section 44 is suction held.

Besides, the first cutting unit 6*a* includes a Y-axis movable piece 60 supported by an appropriate support member (not illustrated) movably in the Y-axis direction, and a Z-axis movable piece 62 supported by the Y-axis movable piece 60 movably in the Z-axis direction, as illustrated in FIG. 1. The housing 28 is fixed to a lower end of the Z-axis movable piece 62. Note that the second cutting unit 6*b* may have the same configuration as that of the first cutting unit 6*a*, so that the components of the second cutting unit 6*b* are denoted by the same reference symbols as used for those of the first cutting unit 6*a*, and descriptions thereof are omitted.

As depicted in FIG. 2A and the like, the cutting apparatus 2 in the embodiment illustrated includes a cutting water supply unit (cutting water supply means) 63 for supplying cutting water to the cutting blade 30 and the workpiece. The cutting water supply unit 63 includes a cylindrical supply port 63*a* provided additionally to the main section 36 of the blade cover 34, and a pair of nozzles 63*b* communicating with the supply port 63*a*. The supply port 63*a* communicates with a cutting water supply source (not illustrated), and a water channel (not illustrated) providing communication between the supply port 63*a* and the cutting water supply source is provided with a valve (not illustrated) for opening and closing the wafer channel. As illustrated in FIGS. 2B and 2C, the nozzle 63*b* is formed with a plurality of jet holes 63*c*. In the cutting water supply unit 63, at the time of cutting the workpiece held on the holding mechanism 4 by the cutting unit 6, cutting water supplied from the cutting water supply source to the supply port 63*a* is jetted through the jet holes 63*c* of the nozzles 63*b* to the cutting blade 30 and the workpiece.

As depicted in FIGS. 3 and 4, a control unit (control means) 64 for controlling the operation of the cutting apparatus 2 is electrically connected to the pressure gauge 56, and a value measured by the pressure gauge 56 is sent to the control unit 64. The control unit 64 including a computer has a central processing unit (CPU) that performs arithmetic processing according to a control program, a read only memory (ROM) that stores the control program and the like, and a random access memory (RAM) that is capable of reading and writing and that stores the result of arithmetic processing and the like (neither of them illustrated).

The control unit 64 has a suction checking function of determining that foreign matter is clogged in the suction hole 50 of the mount 32 and issuing an instruction on removal of the foreign matter in a case where the value of the pressure gauge 56 before mounting of the cutting blade 30 onto the mount 32 is less than a first predetermined value (for example, an absolute pressure on the order of 0.09 MPa), and a mounting checking function of inhibiting start of rotation of the rotary shaft 26 in a case where the value of the pressure gauge 56 after mounting of the cutting blade 30 onto the mount 32 does not reach a second predetermined pressure (for example, an absolute pressure on the order of 0.03 MPa) a smaller than the first predetermined value and permitting the start of rotation of the rotary shaft 26 in a case where the value of the pressure gauge 56 after mounting of the cutting blade 30 onto the mount 32 has reached the second predetermined value.

An operation panel 66 for inputting an operation instruction and the like is electrically connected to the control unit 64. The operation panel 66 includes, for example, a touch panel or a keyboard. As depicted in FIGS. 3 and 4, a suction check start button 68 for instructing the control unit 64 to start the suction checking function and a mounting check start button 70 for instructing the control unit 64 to start the mounting checking function are displayed on the operation panel 66.

It is preferable that the control unit 64 is configured to inhibit execution of the mounting checking function in a case where the value of the pressure gauge 56 when the suction checking function is performed is less than the first predetermined value, and permits execution of the mounting checking function in a case where the value of the pressure gauge 56 is equal to or more than the first predetermined value. As a result, execution of the mounting checking function with the foreign matter not removed from the suction hole 50 is prevented.

For example, the control unit 64 may be set not to execute the mounting checking function even when the mounting check start button 70 is depressed, unless the value of the pressure gauge 56 when the suction checking function is performed is equal to or more than the first predetermined value. Alternatively, in the case where the operation panel 66 is a touch panel, the control unit 64 may not display the mounting check start button 70 on the operation panel 66 unless the value of the pressure gauge 56 when the suction checking function is performed is equal to or more than the first predetermined value.

As depicted in FIG. 1, the feeding mechanism 8 in the embodiment illustrated includes an X-axis feeding mechanism 72, a first Y-axis feeding mechanism 74*a* and a second Y-axis feeding mechanism 74*b* disposed on a gate-shaped frame (not illustrated) disposed astride the base 12, and a first Z-axis feeding mechanism 76*a* and a second Z-axis feeding mechanism 76*b*. The X-axis feeding mechanism 72 includes a ball screw 78 connected to the X-axis movable plate 14 and extending in the X-axis direction, and a motor 80 for rotating the ball screw 78. The X-axis feeding mechanism 72 converts a rotational motion of the motor 80 into a rectilinear motion and transmits the rectilinear motion to the X-axis movable plate 14 by the ball screw 78, and puts the holding mechanism 4 into processing feeding in the X-axis direction relative to the cutting unit 6.

The first Y-axis feeding mechanism 74*a* includes a ball screw 82 connected to the Y-axis movable piece 60 and extending in the Y-axis direction, and a motor 84 for rotating the ball screw 82. The first Y-axis feeding mechanism 74*a* converts a rotational motion of the motor 84 into a rectilinear motion and transmits the rectilinear motion to the Y-axis movable piece 60 by the ball screw 82, and puts the first cutting unit 6 into processing feeding (indexing feeding) in the Y-axis direction relative to the holding mechanism 4. In addition, the second Y-axis feeding mechanism 74*b* may be configured in the same way as the first Y-axis feeding mechanism 74*a*, except that the motor 84 is connected to one end portion in the Y-axis direction of the ball screw 82 in the first Y-axis feeding mechanism 74*a*, whereas the motor 84 is connected to the other end portion in the Y-axis direction of the ball screw 84 in the second Y-axis feeding mechanism 74*b*. The second Y-axis feeding mechanism 74*b* puts the second cutting unit 6*b* into processing feeding (indexing feeding) in the Y-axis direction relative to the holding mechanism 4.

The first Z-axis feeding mechanism 76*a* includes a ball screw (not illustrated) connected to the Z-axis movable piece 62 and extending in the Z-axis direction, and a motor 86 for rotating the ball screw. The first Z-axis feeding mechanism 76*a* converts a rotational motion of the motor 86 into a rectilinear motion and transmits the rectilinear motion to the Z-axis movable piece 62 by the ball screw, and puts the first cutting unit 6*a* into processing feeding (cutting-in feeding) in the Z-axis direction relative to the holding mechanism 4. In addition, the second Z-axis feeding mechanism 76*b*, which may be configured in the same manner as the first Z-axis feeding mechanism 76*a*, puts the second cutting unit 6*b* into processing feeding (cutting-in feeding) in the Z-axis direction relative to the holding mechanism 4.

In cutting by use of the cutting apparatus 2 as aforementioned, first, the suction checking function of the control unit 64 is executed, to check whether or not foreign matter is clogged in the suction hole 50, namely, whether or not the cutting blade 30 can be suction held onto the mount 32 with an appropriate suction holding force.

Before executing the suction checking function, the valve 58 is opened and the suction source 52 is operated in a state in which the cutting blades 30 of both the first and second cutting units 6*a* and 6*b* are detached from the mounts 32. Then, the suction check start button 68 on the operation panel 66 is depressed, to carry out the suction checking function. As a result, the value of the pressure inside the communication passage 54 measured by the pressure gauge 56 is sent to the control unit 64.

At the time of executing the suction checking function, since the cutting blades 30 of both the first and second cutting units 6*a* and 6*b* are in the state of being detached from the mounts 32, if foreign matter is not clogged in the suction hole 50, the pressure inside the communication passage 54 is the first predetermined value (for example, an absolute pressure on the order of 0.09 MPa) close to the atmospheric pressure even when the suction source 52 is operated. Therefore, in a case where the value of the pressure gauge 56 sent to the control unit 64 is less than the first predetermined value, the control unit 64 determines that foreign matter is clogged in the suction hole 50 of the mount 32, and, since the cutting blade 30 may not be suction held onto the mount 32 with an appropriate suction holding force, displays on the operation panel 66 a display of instruction on removal of the foreign matter from the suction hole 50.

In contrast, in a case where the value of the pressure gauge 56 sent to the control unit 64 is equal to or more than the first predetermined value, the control unit 64 determines that foreign matter is not present in the suction hole 50 of the mount 32 and that the cutting blade 30 can be suction held onto the mount 32 with an appropriate suction holding force, displays on the operation panel 66 a display indicating that the cutting blade 30 can be mounted on the mount 32, and finishes the suction checking function.

Before the suction checking function, it is preferable that the suction check start button 68 on the operation panel 66 is represented in a comparatively conspicuous color (for example, yellow) on the operation panel 66, as illustrated in FIG. 3, and, after the suction checking function is finished (when it is represented that the cutting blade 30 can be mounted onto the mount 32), the suction check start button 68 is represented in a comparatively inconspicuous color (for example, grey) on the operation panel 66, as illustrated in FIG. 4. In other words, it is desirable for the control unit 64 to change the color of the suction check start button 68 used for the suction checking function after the suction checking function is finished.

After the suction checking function of the control unit 64 is executed, the mounting checking function of the control unit 64 is performed, to check whether or not the cutting blade 30 has been suction held onto the mount 32 with an appropriate suction holding force.

Before the mounting checking function is executed, the opening 40*a* of the cutting blade 30 is fitted to the boss section 44 of the mount 32, in a state where the operation of the suction source 52 is stopped or the valve 58 is closed. Next, the suction source 52 is operated or the valve 58 is opened, to generate a suction force at the suction hole 50 of the mount 32, and to suction hold (mount) the cutting blade 30 onto the mount 32. Then, the mounting check start button 70 on the operation panel 66 is depressed to execute the mounting checking function. As a result, the value of the pressure inside the communication passage 54 measured by the pressure gauge 56 is sent to the control unit 64.

In a case where the value of the pressure gauge 56 sent to the control unit 64 does not reach the second predetermined value (for example, an absolute pressure on the order of 0.03 MPa) smaller than the first predetermined value, the control unit 64 determines that foreign matter or the like is interposed between the mount 32 and the cutting blade 30, and inhibits start of rotation of the rotary shaft 26. When foreign matter or the like is interposed between the mount 32 and the cutting blade 30, a gap is generated between the mount 32 and the cutting blade 30, and air flows into the communication passage 54 via the gap, so that the pressure inside the communication passage 54 is not lowered to the second predetermined value, and the suction force for holding the cutting blade 30 by the mount 32 does not reach a desired value. Therefore, in a case where the value measured by the pressure gauge 56 does not reach the second predetermined value, the control unit 64 inhibits start of rotation of the rotary shaft 26.

In contrast, in a case where foreign matter or the like is not interposed between the mount 32 and the cutting blade 32, the support section 46 of the mount 32 and the cutting blade 30 make close contact with each other when the cutting blade 30 is suction held onto the mount 30. Then, the pressure inside the communication passage 54 is lowered to the second predetermined value, and the cutting blade 30 is held onto the mount 32 with a desired suction force. Therefore, in a case where the value measured by the pressure gauge 56 has reached the second predetermined value, the control unit 64 permits start of rotation of the rotary shaft 26. Note that the mounting checking function may be separately conducted or simultaneously conducted for the first and second cutting units 6*a* and 6*b*.

Thus, in the cutting apparatus 2 in the present embodiment, the mounting checking function of the control unit 64 ensures that start of rotation of the rotary shaft 26 is inhibited in a case where the value of the pressure gauge 56 after mounting of the cutting blade 30 onto the mount 32 has not reached the second predetermined value, and the start of rotation of the rotary shaft 26 is permitted in a case where the value of the pressure gauge 56 after mounting of the cutting blade 30 onto the mount 32 has reached the second predetermined value. Therefore, in a case where foreign matter is interposed between the mount 32 and the cutting blade 30 and where a sufficient suction force cannot be obtained, cutting is not started, so that neither the wafer nor the cutting blade 30 is damaged.

In addition, in the cutting apparatus 2 in the present embodiment, the suction checking function of the control unit 64 ensures that clogging with foreign matter is detected by the pressure gauge 56 and an instruction on removal of the foreign matter is issued in a case where foreign matter is clogged in the suction hole 50 formed in the mount 32, before the cutting blade 30 is mounted onto the mount 32. Therefore, it is possible to suppress to a low level the possibility that the cutting blade 30 may not be sufficiently held, notwithstanding the value of the pressure gauge 56 upon mounting of the cutting blade 30 onto the mount 32 is appropriate, with the result that the wafer and the cutting blade 30 may be damaged upon cutting by rotating the cutting blade 30.

Note that an example in which the two cutting units 6 are provided has been explained in the description of the cutting apparatus 2 in the present embodiment, however, only one cutting unit 6 may be provided.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A cutting apparatus comprising:

a holding mechanism that holds a workpiece;

a cutting unit that rotatably supports a cutting blade, with a cutting edge provided at a periphery of the cutting blade, for cutting the workpiece held by the holding mechanism; and a feeding mechanism that puts the holding mechanism and the cutting unit into relative processing feeding, wherein the cutting unit has a rotary shaft, a housing that rotatably supports the rotary shaft, and a mount that is formed at a tip end of the rotary shaft and that holds the cutting blade, the mount has a boss section that is inserted into an opening formed in a center of the cutting blade, a ring-shaped support section that is formed at a periphery of the boss section and that supports the cutting edge of the cutting blade in an exposed state, a suction hole that is opened between the boss section and the support section and that suction holds the cutting blade, and a communication passage causing the suction hole to communicate with a suction source, a pressure gauge is disposed in the communication passage and a control unit is connected to the pressure gauge, and the control unit has a suction checking function of determining that foreign matter is clogged in the suction hole and issuing an instruction on removal of the foreign matter in a case where a value of the pressure gauge before mounting of the cutting blade onto the mount is less than a first predetermined value, and a mounting checking function of inhibiting start of rotation of the rotary shaft in a case where the value of the pressure gauge after mounting of the cutting blade onto the mount does not reach a second predetermined value smaller than the first predetermined value and permitting the start of rotation of the rotary shaft in a case where the value of the pressure gauge after mounting of the cutting blade onto the mount has reached the second predetermined value.

2. The cutting apparatus according to claim 1, further comprising:

an operation panel that displays a button used for the suction checking function, wherein the control unit changes a color of the button used for the suction checking function after the suction checking function is finished.

3. The cutting apparatus according to claim 1, wherein the control unit inhibits execution of the mounting checking function in a case where the value of the pressure gauge when the suction checking function is performed is less than the first predetermined value, and permits execution of the mounting checking function in a case where the value of the pressure gauge when the suction checking function is performed is equal to or more than the first predetermined value.

* * * * *